US005660277A

United States Patent [19]

Bostic

[11] Patent Number: 5,660,277

[45] Date of Patent: Aug. 26, 1997

[54] COIL PROTECTOR

[75] Inventor: Jim Bostic, Avon Lake, Ohio

[73] Assignee: Roll Form Tech Ltd., North Ridgeville, Ohio

[21] Appl. No.: 623,330

[22] Filed: Mar. 27, 1996

[51] Int. Cl.[6] ..... B65D 85/66

[52] U.S. Cl. ..... 206/397; 206/414; 206/415

[58] Field of Search ..... 206/1.5, 389, 397, 206/53, 403, 413, 414, 415, 416; 53/139.5, 139.7

[56] References Cited

U.S. PATENT DOCUMENTS 4,793,485 12/1988 Bestolotti ..... 206/414 X 4,995,512 2/1991 Liebel ..... 206/416 X

*Primary Examiner*—Jacob K. Ackun

*Attorney, Agent, or Firm*—Watts, Hoffmann, Fisher & Heinke

[57] ABSTRACT

A coil protector for protecting end portions of a coil of metal, paper or other material includes a shield member for protecting an end portion of the coil. The shield member has a central opening and fasteners disposed around the central opening. A retaining member connects the shield member to an end portion of the coil. The retaining member includes a flange portion and a fastening portion extending transverse to the flange portion. The fasteners connect the flange portion to the shield member. The fastening portion has an adjustable size for engaging the inner surface of the coil.

15 Claims, 3 Drawing Sheets

COIL PROTECTOR

FIELD OF THE INVENTION

The present invention relates to a device for protecting the ends of a coil of metal, paper or other material.

BACKGROUND OF THE INVENTION

Steel, paper and other materials are often coiled for transport and storage. Metal wire may also be coiled for making contoured wire clips used for transmissions. A coil has two end portions each with an end face. An inner surface of the coil defines an opening that extends from one end face of the coil to the other. The diameter of the coil opening is determined by the diameter of a spindle upon which the material is coiled. In the steel industry, the spindle may range, for example, from 16½% inches to 24 inches in diameter.

The coils may be transported to different locations. For example, coils of steel strip may be transported to warehouses of a steel plant and to destinations outside the steel plant, where the coils are stored on their side. Coils are typically transported using any form of lifting device, such as a crane or a "forklift" truck.

The lifting device may come into contact with an end portion of the coil, which damages the coiled material and may require scrapping it. Therefore, a one-piece unbroken metal ring may be inserted into the opening in the end of the coil. The metal ring has a flange that extends only a few inches outside the coil opening along the end face. Thus, the majority of the area of the coil end face is unprotected and susceptible to damage by the lifting device.

SUMMARY OF THE INVENTION

The present invention overcomes the problems of damaged coil end portions during transit and generally relates to a device including a coil shield member for protecting an end portion of the coil. The shield member has a central opening and fasteners disposed around the opening. A retaining member connects the shield member to an end portion of the coil. The retaining member includes a flange portion and a fastening portion that extends transverse to the flange portion. The fasteners of the shield member connect the flange portion of the retaining member to the shield member. The fastening portion has an adjustable size for engaging the inner surface of the coil.

In a preferred form each of the fasteners is a tab that has a portion that is spaced apart from the body portion of the shield member to form a slot between each of the tabs and the body portion. The slots of each of the tabs face the shield member opening.

The shield member is preferably comprised of a flexible elastomeric material and the retaining member is preferably comprised of metal. The shield member has a generally annular disk shape and preferably covers a majority of the end face of the coil. The flange portion of the retaining member is generally annular and its fastening portion is a split ring. Even more preferably both the fastening portion and the flange portion are split to enable the size of the retaining member to be adjusted. The flange portion of the retaining member may include one or more circumferentially spaced weakening slits.

The shield member protects the end face of the coil against damage from the lifting device. This saves money by avoiding having to scrap damaged coil material or having to discount the price of the damaged coil. The coil protector is able to be as quickly and easily fastened to the coil as the one-piece metal ring. The device is also advantageous in that by having two separate components, the shield member and the retaining member, either component when damaged may be individually replaced without replacing the entire coil protector.

A method of the present invention includes the steps of inserting the fastening portion of the retaining member into the central opening of the shield member. The shield member is fastened to the flange portion of the retaining member. The size of the fastening portion of the retaining member is reduced by compressing the fastening portion. The compressed fastening portion is then inserted into the coil opening and released to engage the inner surface of the coil.

Other embodiments of the invention are contemplated to provide particular features and structural variants of the basic elements. The specific embodiments referred to as well as possible variations and the various features and advantages of the invention will become better understood from the detailed description that follows, together in connection with the accompanying drawings.

DETAILED DESCRIPTION OF PREFERRED EMBODIMENTS

Figure 1:
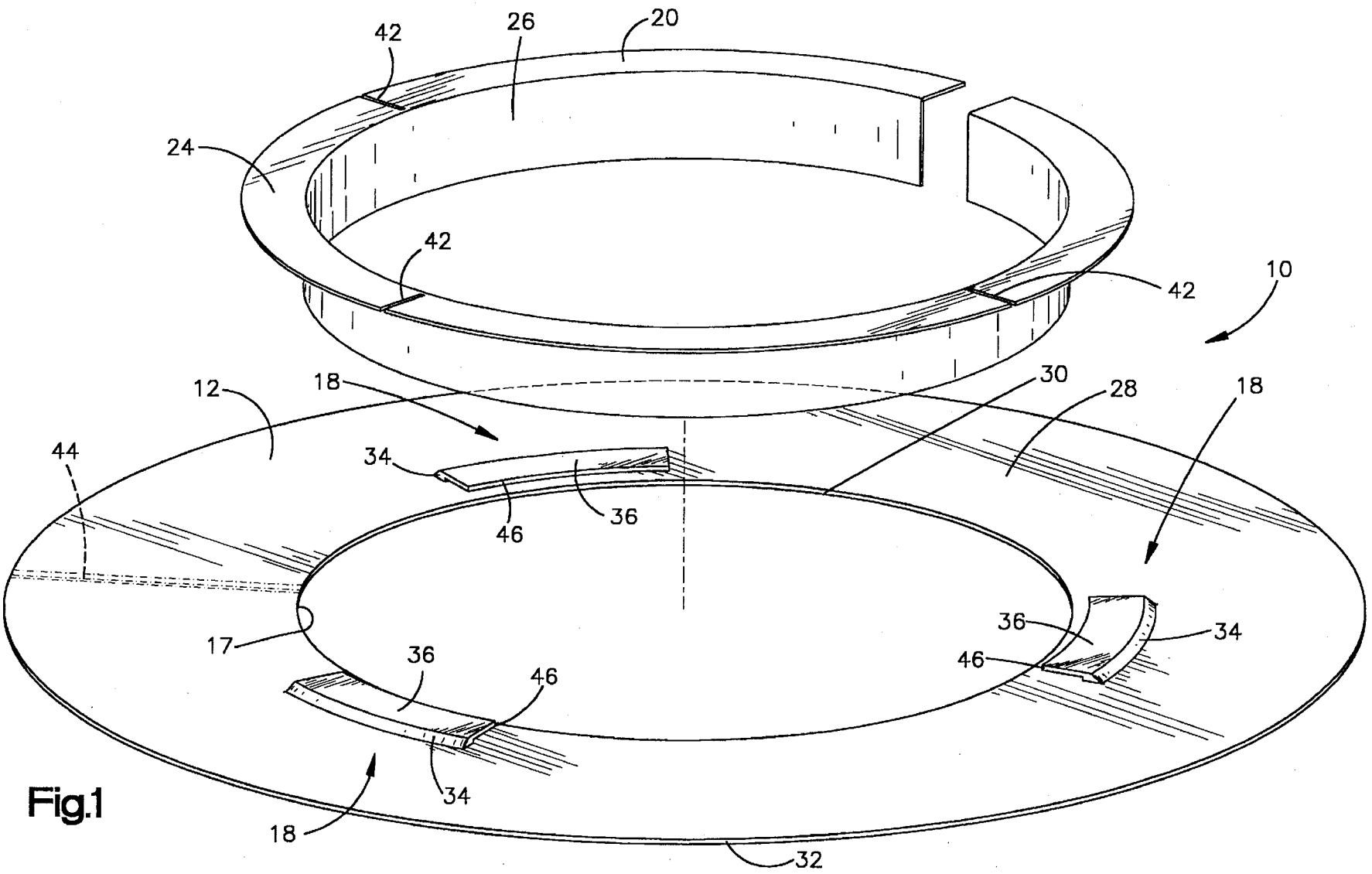
FIG. 1 is a perspective view of a coil protector constructed in accordance with the present invention.
Figure 2:
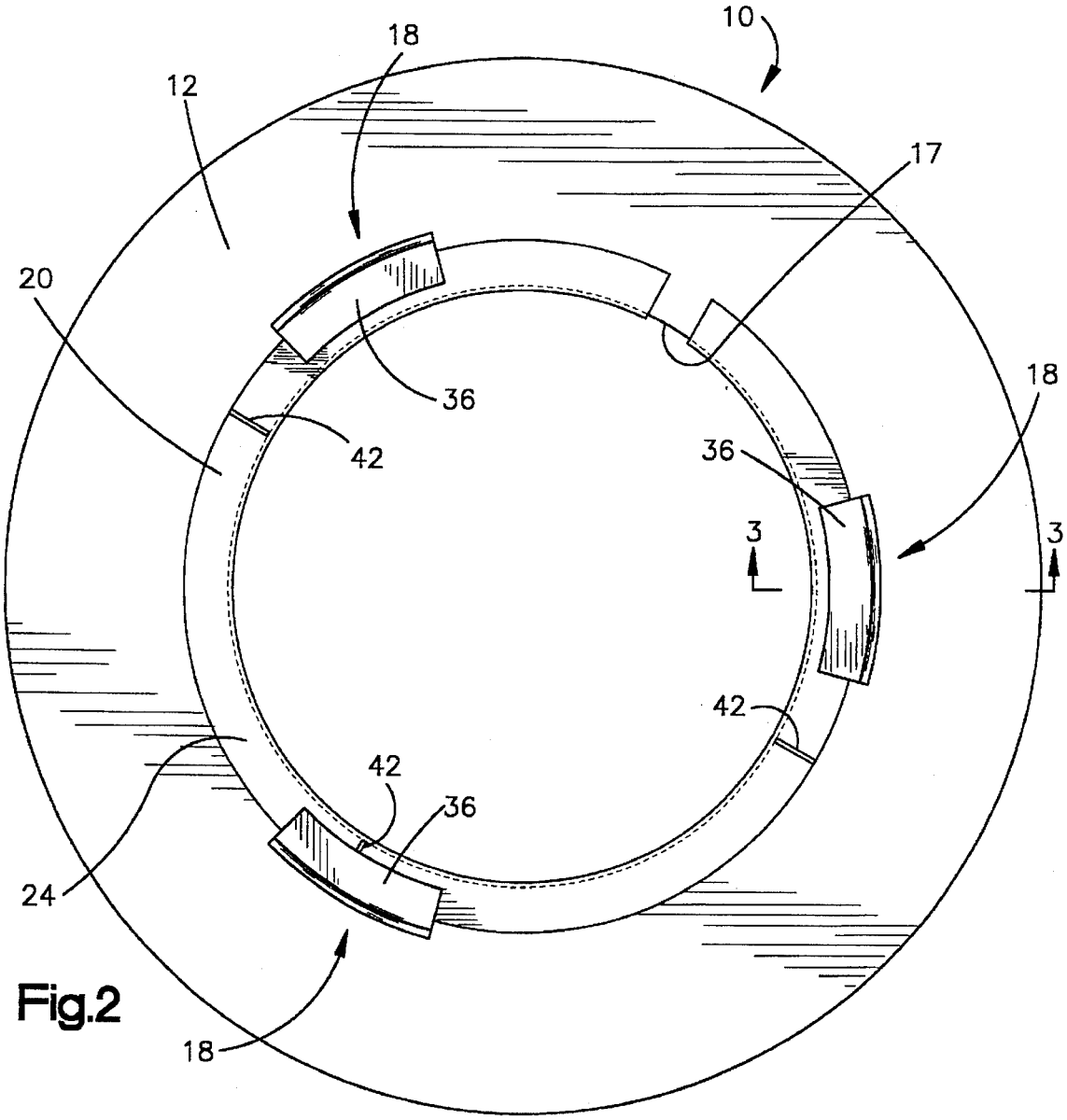
FIG. 2 is a top plan view of the coil protector shown in FIG. 1.
Figure 3:
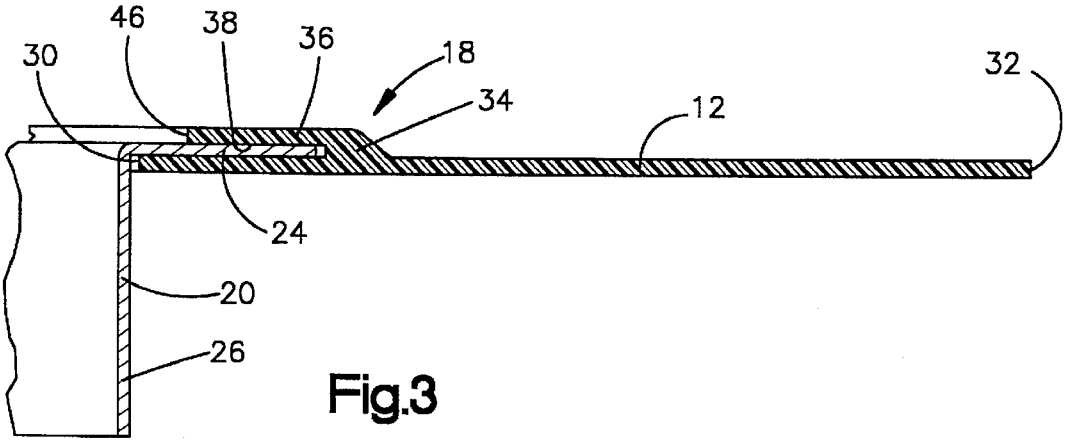
FIG. 3 is a sectional view as seen along the plane designated by lines 3—3 of FIG. 2.

Turning now to FIG. 1 of the drawings a coil protector is shown generally at 10. The coil protector 10 includes a shield member 12 for protecting a metal coil 14 shown in FIG. 4. The coil 14 has a side portion 13 and a central opening 15 extending between end portions 16 of the coil 14. Each of the end portions 16 has an end face F. The shield member 12 has a central opening 17 and tabs 18 disposed around the opening 17. A metal retaining member 20 is fastened to the shield member 12 by the tabs 18 and connects the shield member 12 to one of the coil end portions 16.

The retaining member 20 includes a flange portion 24 and a fastening portion 26 extending transverse to the flange portion 24. The retaining member 20 has an adjustable size for connecting the shield member 12 to the coil 14. That is, once the compressed fastening portion 26 is released, the elasticity of the metal causes the fastening portion 26 to expand toward its original diameter, during which the fastening portion engages the inner surface of the coil 14.

The shield member 12 has a body portion 28 with a preferably generally annular, disk shape. The body portion 28 has an inner peripheral edge 30 that defines the central opening 17 and an outer peripheral edge 32. The tabs 18 are preferably integrally formed with the body portion 28 and circumferentially spaced around the opening 17. Alternatively, the tabs 18 may be formed separately from the shield member 12 and mechanically attached to it. Three or more of the tabs 18 are preferably used.

Each of the tabs 18 includes an upstanding end portion 34 and an overhang portion 36 that extends from the end portion 34. Each overhang portion 36 is spaced from the body portion 28. Slots 38 are each defined by the tab end portion 34, the tab overhang 36 and the body portion 28. The slots 38 of the tabs 18 face the shield member opening 17. It will be appreciated by those skilled in the art that fasteners other than the tabs 18 may be used for connecting the retaining member flange 24 to the shield member 12.

Figure 4:
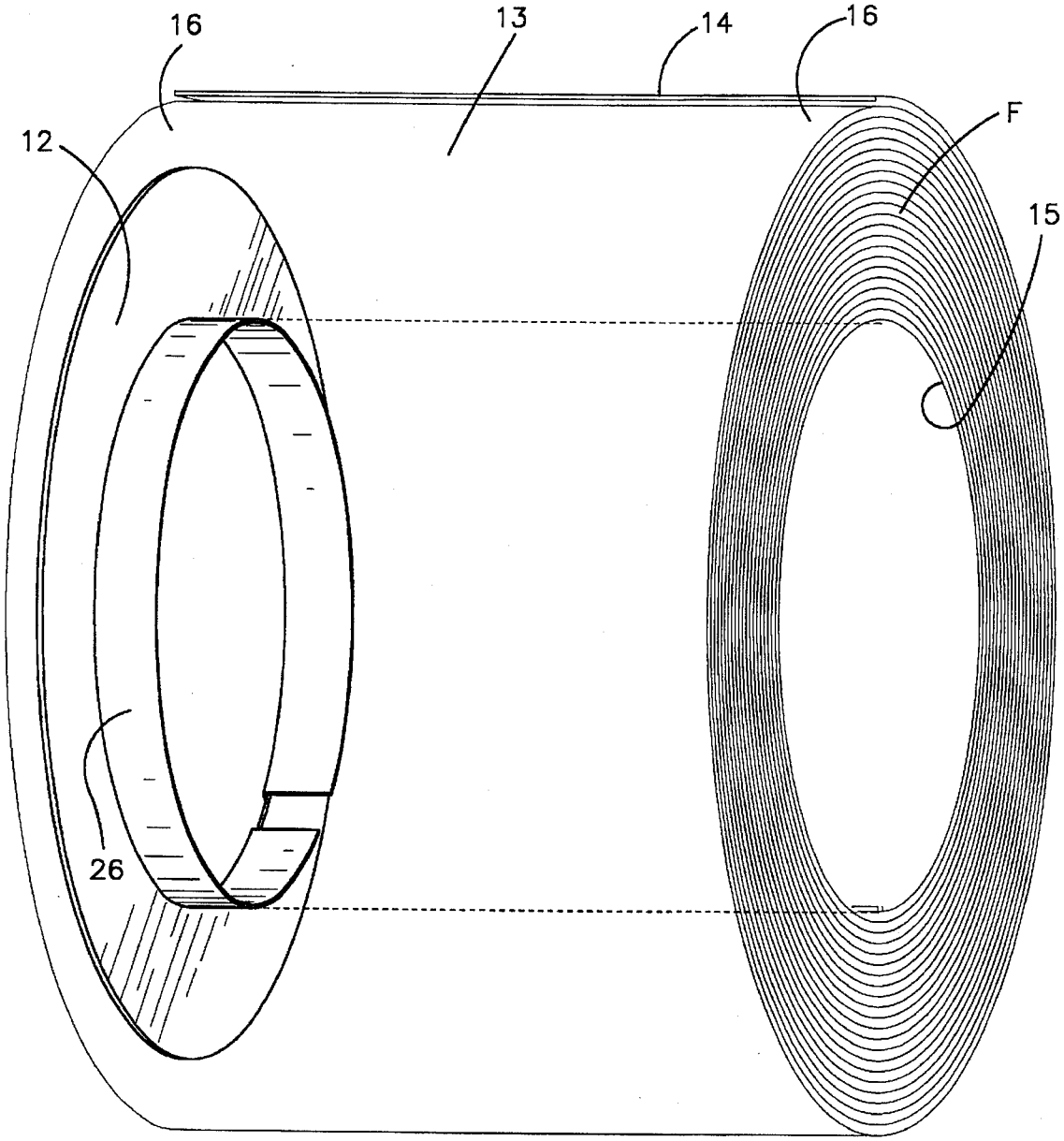
FIG. 4 is a perspective view showing the coil protector of the present invention in a metal coil.

As shown in FIG. 4, the shield member 12 preferably has a size sufficient to cover the majority of the associated end face F of the coil 14. The outer diameter of the shield member 12 may range from 32 to 45 inches.

The shield member 12 is preferably formed of any suitable flexible material. For example, the shield member 12 may be comprised of one or more materials including thermoplastic or thermoset materials, engineering resins and polyolefin materials. These materials may be filled with minerals, synthetic fibers and the like. The most preferable material is high density polyethylene, because it has suitable performance, impact strength and stiffness, and is economical.

The material of the shield member 12 may include additives such as flame retardants and additives for ultraviolet radiation protection. The shield member 12 may be any color but is preferably black because this color resists degradation by ultraviolet radiation.

The material of the shield member 12 preferably has the following properties: a tensile strength ranging from 1000 to 6000 pounds per square inch ("psi"), a brittleness temperature of −180° F., a heat distortion temperature at 66 psi in the range of 100° to 300° F., a Shore D hardness ranging from 40 to 80, and a flexural modulus ranging from 48,000 to 300,000 psi. The shield member 12 may be formed by a process such as die cutting, injection molding, extrusion or machining and is preferably 0.02 to 0.50 inches thick.

The flange portion 24 of the retaining member 20 is preferably generally annular and the fastening portion 26 is preferably generally cylindrical and integrally formed with the flange portion 24. The fastening portion 26 may range from 2 to 4 inches long. The flange portion 24 may be two inches long. The inner diameter of the fastening portion 26 may range from 17 inches to 25 inches.

The flange portion 24 and the fastening portion 26 may both be split to enable them to be generally radially compressed. That is, the flange portion 24 and the fastening portion 26 both have two free ends along their circumference that oppose each other. In addition, the flange portion 24 preferably includes a plurality of radial circumferentially spaced slits 42 that weaken the flange portion 24 to increase the compressibility of the retaining member 20. The retaining member 20 is preferably made out of metal.

The retaining member 20 is preferably connected to the shield member 12 by twisting the shield member 12 to insert the flange portion 24 into the slots 38. As shown in FIG. 1 the shield member 12 may include an optional slit 44. The slit 44 enables the shield member 12 to be more easily twisted. This assists in positioning the retaining member flange portion 24 in the slots 38.

In operation, once the retaining member 20 has been fastened to the shield member 12 the fastening portion 26 is compressed, preferably by the hands of a worker. Compressing the fastening portion 26 also may compress the retaining member flange portion 24. When the fastening portion 26 is compressed, the flange portion 24 and the fastening portion 26 have smaller sizes or, generally, diameters, than in their original, uncompressed condition.

Even in its compressed condition, the flange portion 24 is still retained by the tabs 18. This is because an inner diameter defined by inner edges 46 of the tab overhangs 36 is less than the smallest outer diameter of the flange portion 24 in its compressed condition. In its compressed condition, the fastening portion 26 has a smaller diameter than the coil opening 15. The compressed fastening portion 26 is inserted into the coil opening 15, while the coil 14 rests on its side 13. The shield member 12 is now located adjacent the associated end face F of the coil 14. The worker then releases the compressed fastening portion 26 in the coil opening 15. The elasticity of the metal retaining member 20 causes the fastening portion 26 to expand toward its original diameter, which in turn causes it to contact the inner surface of the coil 14 that defines the coil opening 15. The coil protector 10 may now be pushed by the worker until it abuts against the end face F of the coil 14.

A prong of the lifting machine is inserted into the coil opening 15 and the coil is lifted and moved to its destination. The shield member 12 prevents the lifting device from contacting and thus, damaging the end face F of the coil 14.

Although the invention has been described in its preferred form with a certain degree of particularity, it will be understood that the present disclosure of the preferred embodiments has been made only byway of example and that various changes may be resorted to without departing from the true spirit and scope of the invention as hereafter claimed.

What is claimed is:

1. A coil protector for protecting end portions of a coil of material, the coil having an inner surface that defines a central opening extending between the end portions, the coil protector comprising a shield member for protecting an end portion of the coil, said shield member having a central opening and fasteners disposed around the central opening, and a retaining member for connecting said shield member to the end portion of the coil, said retaining member including a flange portion and a fastening portion extending transverse to said flange portion, said fasteners connecting said flange portion to said shield member, and said fastening portion having an adjustable size for engaging the inner surface of the coil.

2. The coil protector of claim 1 said shield member being comprised of a flexible elastomeric material and said retaining member being comprised of metal.

3. The coil protector of claim 1 said shield member having a generally annular disk shape.

4. The coil protector of claim 1 said flange portion being generally annular.

5. The coil protector of claim 1 said fastening portion being a split ring.

6. The coil protector of claim 1 said fastening portion and said flange portion being split.

7. The coil protector of claim 1 said flange portion including one or more circumferentially spaced weakening slits.

8. The coil protector of claim 1 the coil protector being constructed to protect the end portions of a coil of steel sheet.

9. A coil protector for protecting end portions of a coil of material, the coil having an inner surface that defines a central opening extending between the end portions, the coil protector comprising a shield member having a body portion with a central opening and tabs circumferentially spaced around the central opening, each of said tabs having a portion that is spaced apart from said body portion to form a slot between each of said tabs and said body portion, and a retaining member for connecting said shield member to an end portion of the coil, said retaining member including a flange portion and a fastening portion extending transverse to said flange portion, said tabs connecting said flange portion to said shield member, and said fastening portion having an adjustable size for engaging the inner surface of the coil.

10. The coil protector of claim 9 said shield member being comprised of a flexible elastomeric material and said retaining member being comprised of metal.

11. The coil protector of claim 9 said shield member having a generally annular disk shape.

12. The coil protector of claim 9 said flange portion being generally annular and said fastening portion being a split ring.

13. The coil protector of claim 9 said fastening portion and said flange portion being split.

14. The coil protector of claim 9 said flange portion including one or more circumferentially spaced weakening slits.

15. A method of protecting end portions of a coil of material, the coil having an inner surface that defines a central opening extending between the end portions, comprising the steps of inserting a fastening portion of a retaining member into a central opening of a shield member, fastening to said shield member a flange portion of the retaining member that extends transverse to said fastening portion, compressing said fastening portion to reduce its size, inserting said compressed fastening portion into the coil opening, and releasing said compressed fastening portion in the coil opening to engage the inner surface of the coil.

* * * * *